US006708623B2

(12) United States Patent
Cummins

(10) Patent No.: US 6,708,623 B2
(45) Date of Patent: Mar. 23, 2004

(54) SUPPORT STRUCTURE

(75) Inventor: Richard D. Cummins, Orchard Park, NY (US)

(73) Assignees: Judith Marie Cummins, Orchard Park, NY (US); Joanne Elizabeth Cummins, West Seneca, NY (US)

( * ) Notice: Subject to any disclaimer, the term of this patent is extended or adjusted under 35 U.S.C. 154(b) by 0 days.

(21) Appl. No.: 10/217,578

(22) Filed: Aug. 13, 2002

(65) Prior Publication Data

US 2003/0101896 A1 Jun. 5, 2003

Related U.S. Application Data

(63) Continuation-in-part of application No. 10/013,037, filed on Oct. 30, 2001, now abandoned.
(60) Provisional application No. 60/312,909, filed on Aug. 16, 2001.

(51) Int. Cl.[7] ..... E01D 19/14
(52) U.S. Cl. ..... 104/156; 104/89; 104/124; 104/125; 14/4
(58) Field of Search ..... 104/156, 89, 91, 104/118, 119, 124–126, 164; 105/141–147; 52/29, 40, 731.5, 653.1, 651.01, 651.07; 14/3, 21, 75, 4, 13, 77.1, 78; 248/163.1, 164

(56) References Cited

U.S. PATENT DOCUMENTS

| | | | | | |
|---|---|---|---|---|---|
| 1,998,205 | A | * | 4/1935 | Roscher | 104/124 |
| 2,055,971 | A | * | 9/1936 | Fraser | 104/124 |
| 3,244,113 | A | * | 4/1966 | Smyser | 104/112 |
| 3,430,582 | A | * | 3/1969 | Appelt et al. | 104/124 |
| 3,534,689 | A | | 10/1970 | Barthalon | |
| 4,128,219 | A | | 12/1978 | Kaigler, Jr. et al. | |
| 4,221,170 | A | * | 9/1980 | Koudelka | 104/125 |
| 4,264,996 | A | * | 5/1981 | Baltensperger et al. | 104/125 |
| 4,274,336 | A | | 6/1981 | Pater et al. | |
| 4,334,480 | A | * | 6/1982 | Wallace | 104/126 |
| 4,489,659 | A | * | 12/1984 | Kamohara et al. | 104/124 |
| 4,665,830 | A | | 5/1987 | Anderson et al. | |
| 5,022,542 | A | * | 6/1991 | Beier | 104/126 |
| 5,027,713 | A | | 7/1991 | Kindmann et al. | |
| 5,385,249 | A | * | 1/1995 | Long, Jr. | 104/126 |
| 5,437,072 | A | * | 8/1995 | Dinis et al. | 14/14 |
| 5,460,098 | A | * | 10/1995 | Jackson et al. | 104/124 |
| 5,566,620 | A | * | 10/1996 | Siewert | 104/124 |
| 5,809,897 | A | | 9/1998 | Powell et al. | |

FOREIGN PATENT DOCUMENTS

| | | | |
|---|---|---|---|
| DE | 19638578 | A | 9/1996 |
| GB | 2305645 | A | 10/1995 |

* cited by examiner

*Primary Examiner*—Dennis H. Pedder
*Assistant Examiner*—Greg Blankenship
(74) *Attorney, Agent, or Firm*—Simpson & Simpson, PLLC

(57) ABSTRACT

An improved support structure capable of supporting a guideway in the form of a tube or tubes which may in turn carry a train for travel thereupon, which elevated guideway is capable of passing over existing right-of-ways, rolling or mountainous terrain, and rivers of moderate size. The improved support structure provides a uniform vertical thermal expansion and uniform loading deflection (due to the weight of a passing train) thus assuring that the elevated tubes are smooth and straight.

11 Claims, 16 Drawing Sheets

SUPPORT STRUCTURE

CROSS REFERENCE TO RELATED APPLICATIONS

The present invention is related to the AIR LEVITATED TRAIN disclosed in U.S. Pat. No. 5,909,710, to the PRESSURE COMPENSATED PIPELINE JUNCTION disclosed in U.S. patent application Ser. No. 09/593,788, filed Jun. 14, 2000, and to the ALL-WEATHER GUIDED VEHICLE SYSTEM disclosed in U.S. patent application Ser. No. 09/533,638, filed Mar. 22, 2000, now abandoned in favor of continuation-in-part application Ser. No. 10/013,037 filed Oct. 30, 2001 now abandoned, which claims the benefit of Provisional Application No. 60/312,909 filed Aug. 16, 2001, the subject matter of which is incorporated herein by reference thereto.

TECHNICAL FIELD

The present invention relates generally to improved support structures, and more particularly to improved stanchions capable of supporting one or more elevated tubular structures, for example a guideway, which may in turn carry a plurality of carriages for travel thereupon.

BACKGROUND OF THE INVENTION

Elevated rail systems are well known in the art. However, most such systems have been developed for use in cities where the speed of the vehicles are relatively low. Rail systems between cities are typically placed upon the ground if possible, and to this end considerable grade development is involved to make the track bed as straight and level as possible. When high speed systems are developed, even more effort is made to insure level and straight right-of-ways. Elevated structures have been used between cities only where the terrain will not support a road bed as desired, typically to cross rivers and the like.

Ground level right-of-ways are becoming increasingly expensive and it is desirable to produce an elevated high speed passenger transport system between major cities. To this end it is necessary to provide an interurban elevated system.

Prior art elevated systems are known. Typical examples are U.S. Pat. Nos. 3,238,894, 3,534,689, 4,274,336, 4,632,038, 4,665,830, 5,027,713, and 5,809,897, German 196 38 578, Great Britain 2 305 645, and PCT printed application WO 96/27516. Finally, U.S. Pat. No. 4,181,995 discloses a bridging structure for road or rail traffic. However, none of these patents disclose an elevated roadway which can be used between cities where there is a design which is capable of passing along existing right-of-ways, for traversing over rolling or mountainous terrain, and for crossing rivers of moderate size.

It is also known to support elevated tubular structures, such as pipe lines. U.S. Pat. No. 4,128,219 discloses an elevated pipeline. But, as can be seen from this patent, little thought has been given to providing supports for a pipeline over rolling terrain where one of the objects is to keep the pipeline relatively straight. Furthermore, little thought has been given to developing a support structure which has equal vertical temperature expansion and has effectively equal load bearing resilience. There are two known methods for accommodating the expansion of a tube or pipeline. In one design, frequent (relatively closely spaced) "U" bends in the tube are employed. In a second design, closely spaced pressure sealing expansion joints are used. Both methods are expensive, requiring more structural support, while the "U" bends impede the internal flow and become excessively long with large diameter pipes or tubes. It is therefore very desirable to locate expansion mechanisms as far apart along the tubes as reasonable, the pressure compensated pipeline junction expansion joint is better suited for this purpose than the "U" bend (for pressurized large tubes). However, the tube or pipeline must be adequately supported while it is expanding and contracting. The pressure compensated pipeline junction expansion joint can easily function over an expansion range of 100 feet, so that the joints, (one at each end of a tube section), may be as much as 22 miles apart. This design is shown in applicants copending application Ser. No. 09/593,788, filed Jun. 14, 2000, for a PRESSURE COMPENSATED PIPELINE JUNCTION.

OBJECTS AND SUMMARY OF THE INVENTION

It is an object of the present invention to provide improved support structure capable of supporting a railway, roadway, or pipeline.

More particularly, it is an object of the present invention to provide improved support structure capable of supporting a guideway in the form of a tube or tubes which may in turn carry a train for travel thereupon, which elevated guideway is capable of passing over existing right-of-ways, rolling or mountainous terrain, and rivers of moderate size, the improved support structure providing a uniform vertical thermal expansion and uniform loading deflection (due to the weight of a passing train) thus assuring that the elevated tubes are smooth and straight.

It is a further object of the present invention to provide an improved support structure for a guideway which accommodate supporting the guideway on novel stanchions, and by unlimited expansion of the guideway by passing the guideway across the stanchion on rollers.

It is another object of the present invention to utilize the inherent stiffness of the tubes of the elevated guideway to further assure that they are smooth and straight.

Another object of the present invention is to provide a support structure including stanchions and ground footings, wherein at least as many as three tube spans may be carried between stanchion ground footings.

A further object of the present invention is to provide virtually unlimited guideway height with a minimal number of structural components.

Yet another object of the present invention is to provide a support structure which may be linked to other support structures in a continuous series without the use of expansion joints, each support structure including a guideway tube assembly which forms a continuous structure for supporting the roadway, railway or pipeline, and a "T" bar assembly for preventing rotation of the guideway tube assembly about a longitudinally extending axis.

A still further object of the present invention is to provide a support structure which has an aesthetically acceptable appearance.

The foregoing objects of this invention will be more fully understood after a consideration of the following detailed description taken in conjunction with the following drawings.

DETAILED DESCRIPTION

Figure 1:
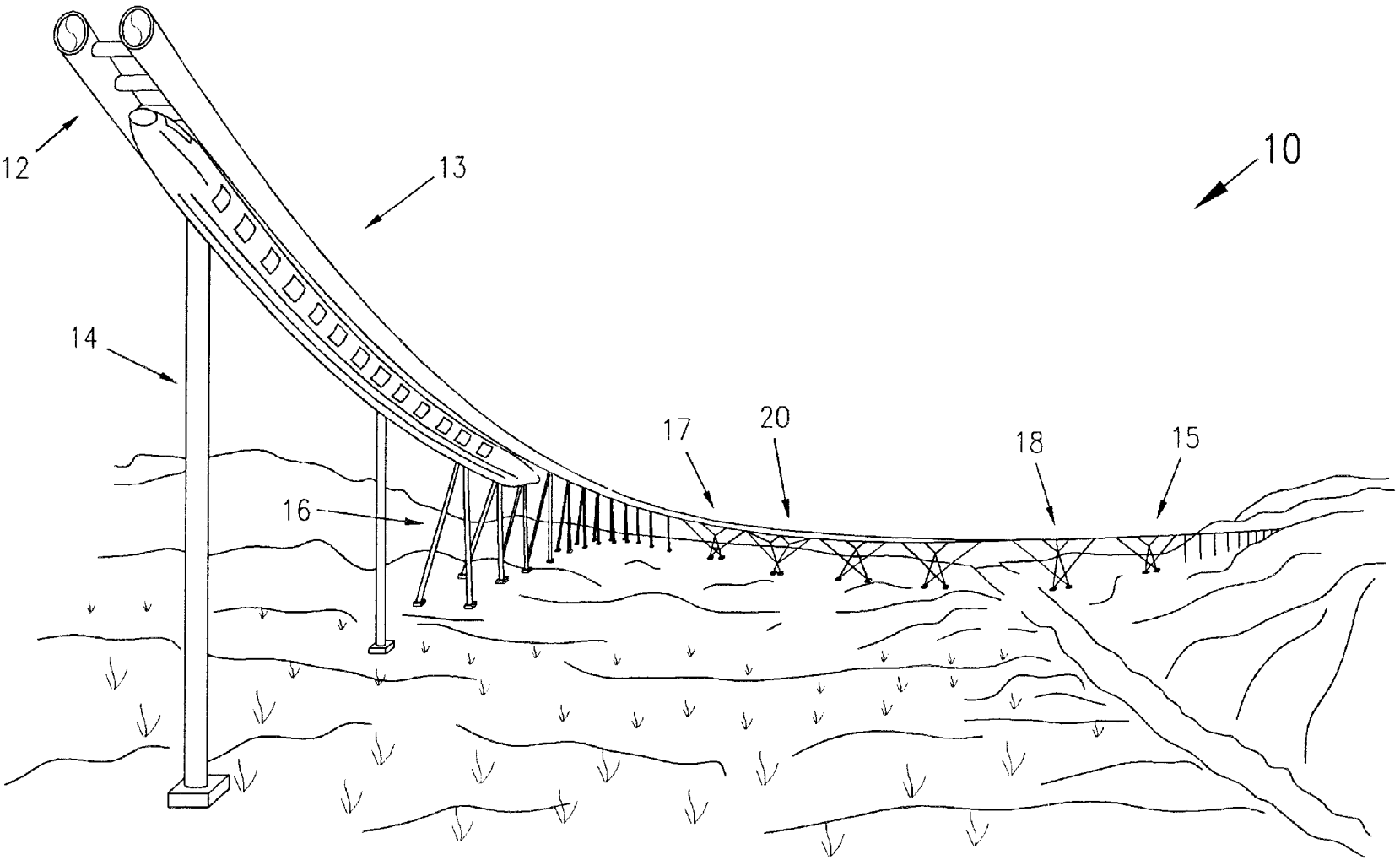
FIG. 1 is a perspective view showing differing species of support structures of this invention when used in a rural setting, the support structure carrying a pair of interconnected guideway tubes and a railway train.

The support structure of this invention is indicated generally at 10 in FIG. 1. It includes a ladder shaped guideway tube assembly, indicated generally at 12, which tube assembly may support a longitudinally extending railway 13, roadway, or pipeline. The support structure also includes a plurality of stanchions 14–20, and wheel sets 24 which extend between the guideway tube assembly and the stanchions. The guideway tube assembly includes a pair of longitudinally extending interconnected relatively rigid guideway tubes 25, which tubes form a continuous structure for supporting the roadway, railway or pipeline, downwardly extending roller supports 26 for supporting the roadbed, railway or pipeline, and transversely extending members 27 for rigidly connecting the pair of guideway tubes to each other. The guideway tube assembly may expand and contract over a range of nine feet per mile, due to ambient temperature variations. By utilizing the support structure of this invention a long length of a ladder shaped guideway tube assembly, which may be miles in length, may be supported by wheel sets so that expansion of the tube assembly may be accommodated.

Figure 3:
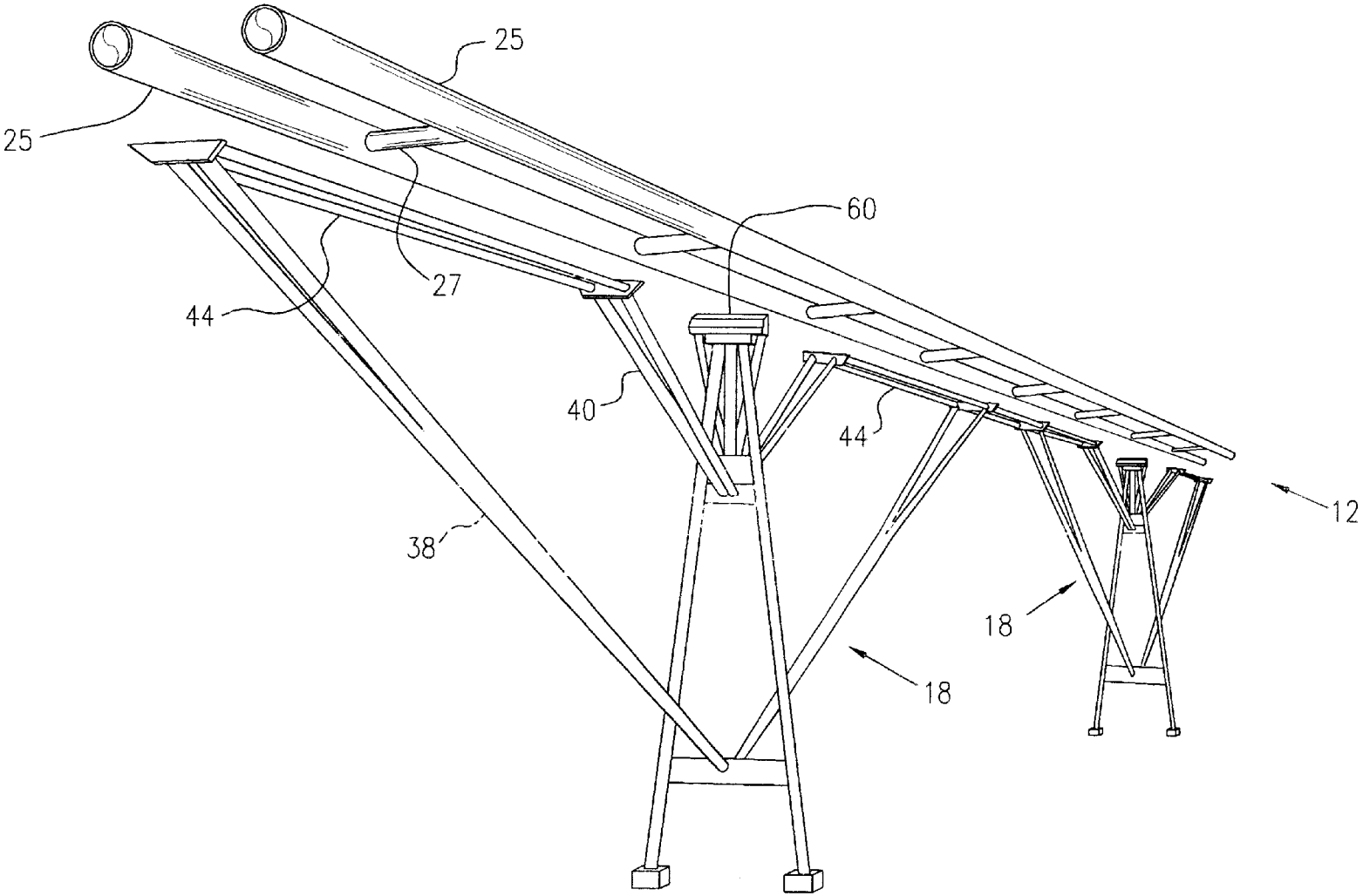
FIG. 3 illustrates an exploded view of a further embodiment of this invention, a pair of support stanchion assemblies being shown along with a pair of interconnected guideway tubes, and a lateral cross bar.
Figure 5:
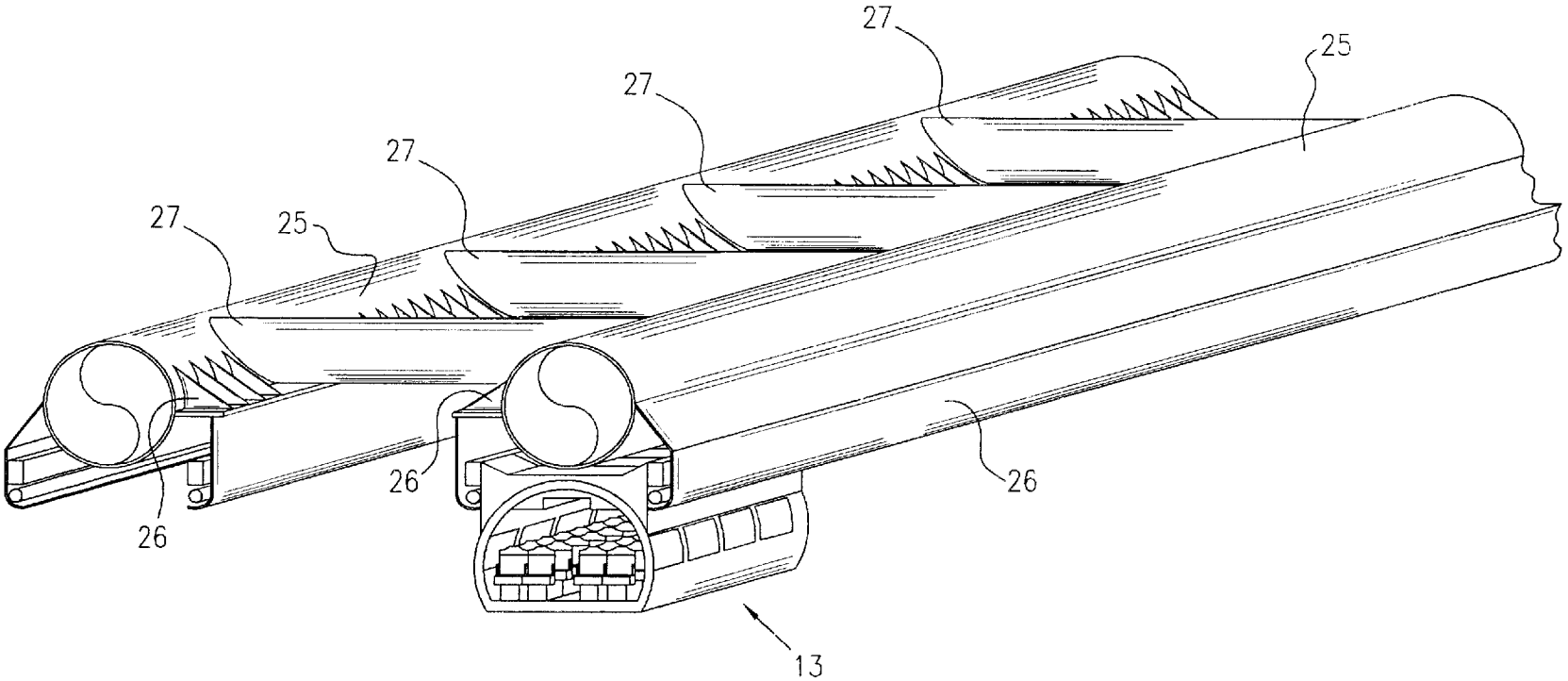
FIG. 5 is a perspective illustration of a portion of the structure shown in FIG. 4.
Figure 10:
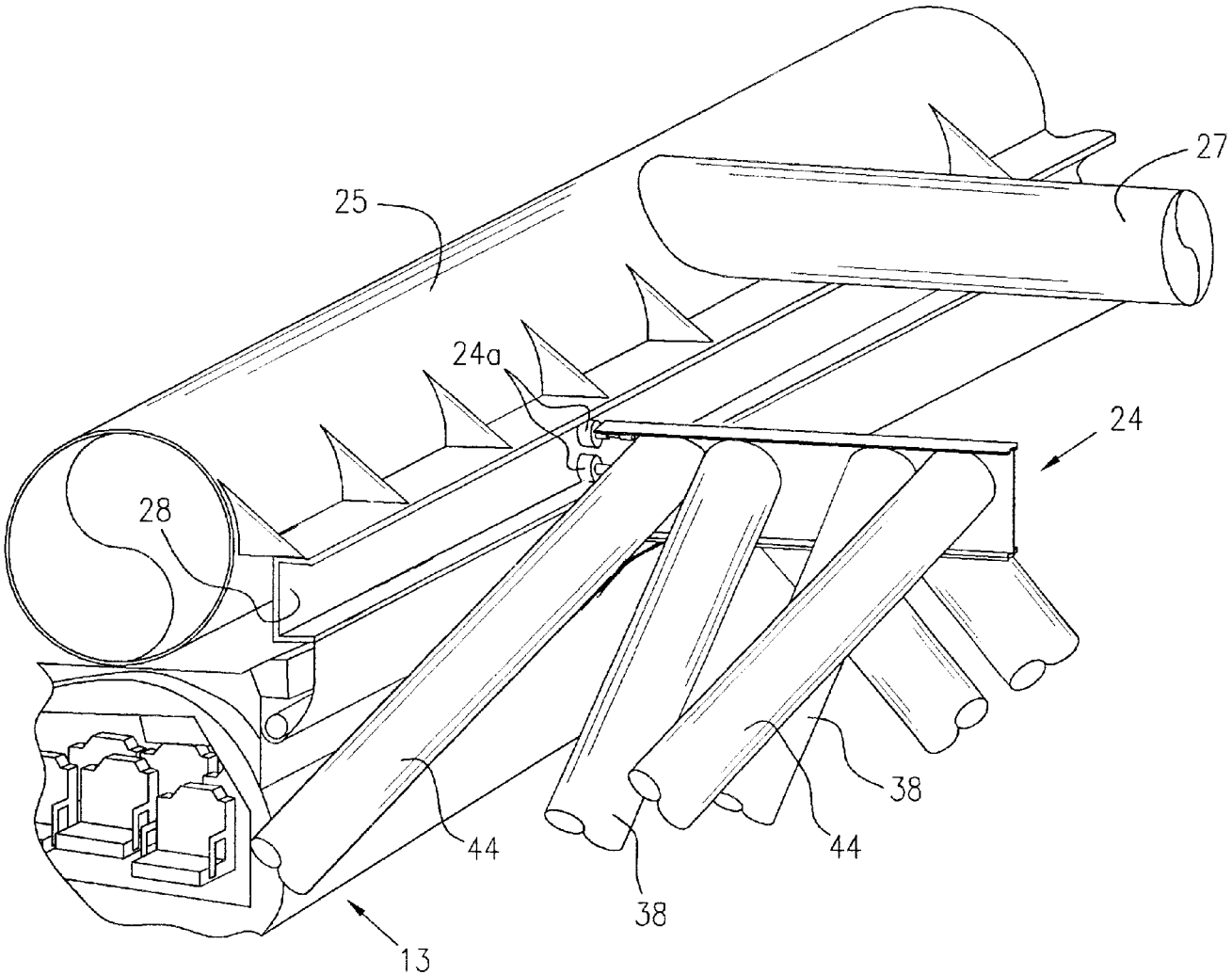
FIG. 10 is a view similar to FIG. 9, but showing how a guideway tube and a train may be supported.
Figure 11:
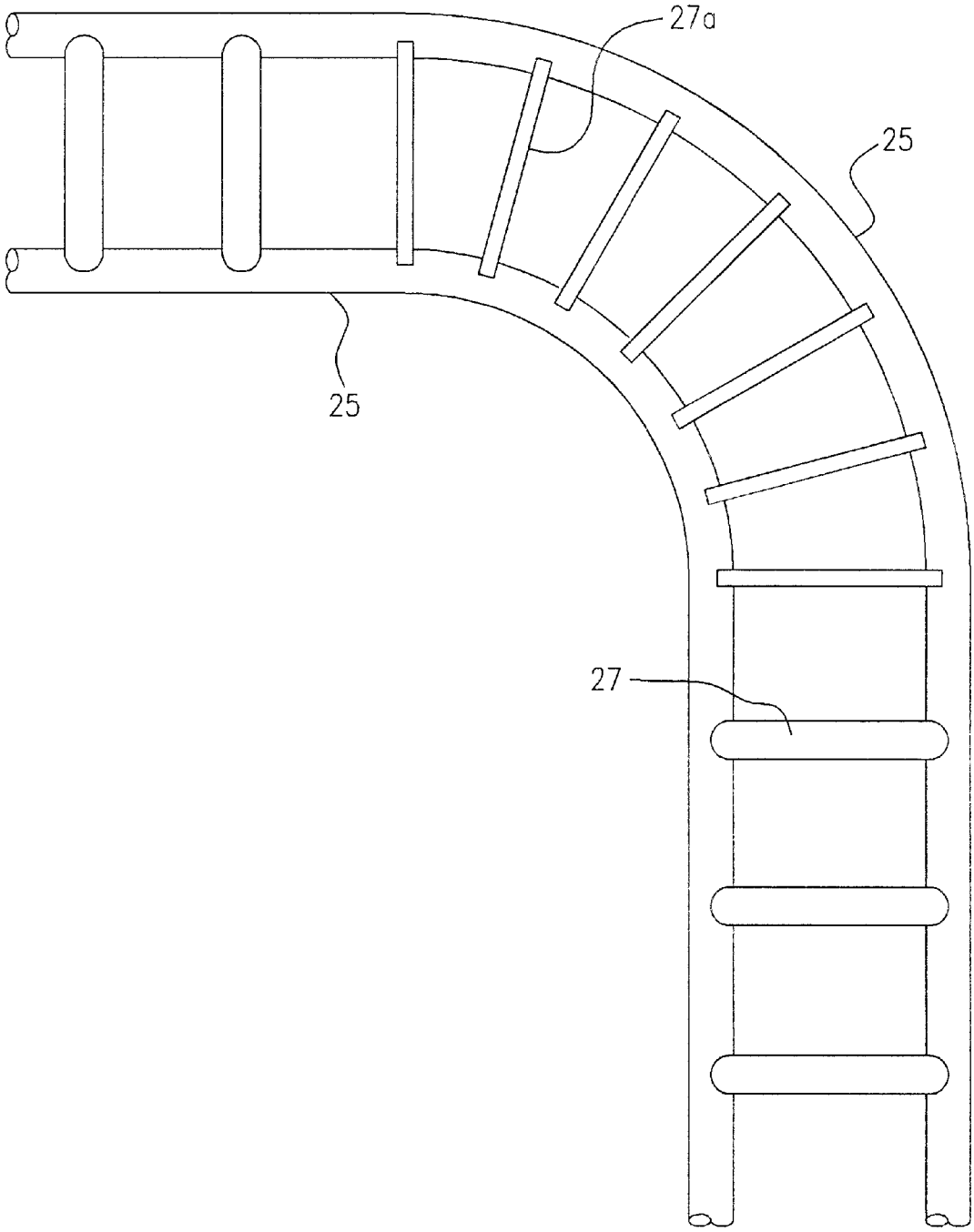
FIG. 11 shows how the guideway is varied for curves.

In straight sections, such as that shown in FIGS. 3, 5, and 10, the transversely extending members 27 may be cross flow tubes. However, in curved sections, conceptually shown in FIG. 11, vertical web plates are employed in lieu of the cross flow tubes. Thus, the illustrated guideway uses vertical, web plates 27*a*, extending radially, connecting the inner to the outer tubes. It is quite flexible longitudinally, yet very rigid in the vertical plane. This permits each tube to transmit the same expansion travel to each end of the curve, whereupon the rigid cross flow tubes may be continued. The guideway tubes may then extend around numerous curves with about 22 miles between 100 foot expansion joints. Another feature of the expansion curve is that the curve cannot begin the full amount of curvature at the tangent point with the approaching straight section. A minimum radius of curvature would be, for example, 40,000 feet for an 8 foot diameter single tube with 3000 psi bending stress. Such a large radius would exclude almost all attractive guideway routes. The rate of curvature must be increased at the approach and decreased at the end of the turn at a rate of no more than 0.143 degrees per 100 feet, until the minimum radius {for the maximum permitted train speed} is reached The desired minimum radius might be, for example, 6000 feet for a 300 m.p.h. train speed. This curvature would gradually be attained within a distance of 400 feet and a curvature angle of 0.95 degrees from the beginning of the curve. This curvature would be maintained up to the end of the full curvature zone, whereupon the curvature would gradually be decreased over the last 400 feet of the curve. Lower train speeds would permit shorter curvature radii, but would require longer "curvatures of approach". Of course, shorter "curvatures of approach" would be used as the curve is located closer to the (fixed) center of the expanding guideway section, because of the shorter expansion travel occurring at that point.

For traversing over rolling or mountainous terrain, it is highly desirable that the guideway assembly 12 be supported in places by a structure which provides virtually unlimited elevation, and maximal distance between ground supports, at a reasonable cost. As any high speed vehicle is extremely sensitive to either vertical or horizontal curvatures or irregularities in its path, it is desirable that these stanchions have equal vertical temperature expansion and have effectively equal load bearing resilience.

Figure 6:
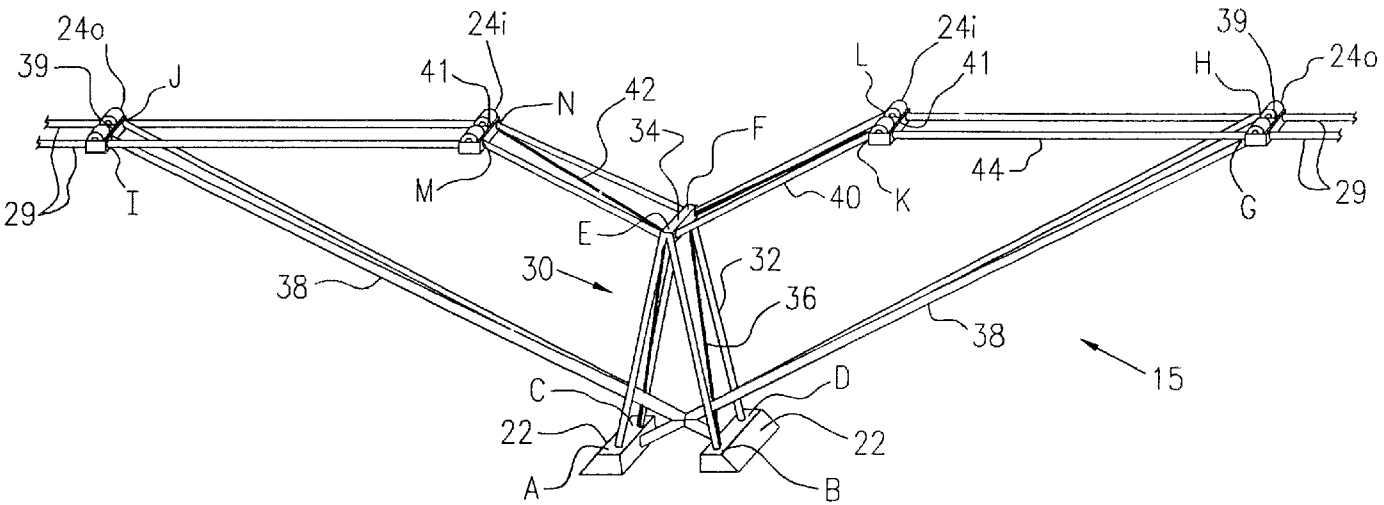
FIGS. 6 and 6A are illustrations of variations of an improved long span stanchion, FIG. 6 being a perspective view of a low clearance variation, and FIG. 6A showing a high clearance variation, and further showing how the long span stanchion may accommodate temperature expansion.
Figure 7:
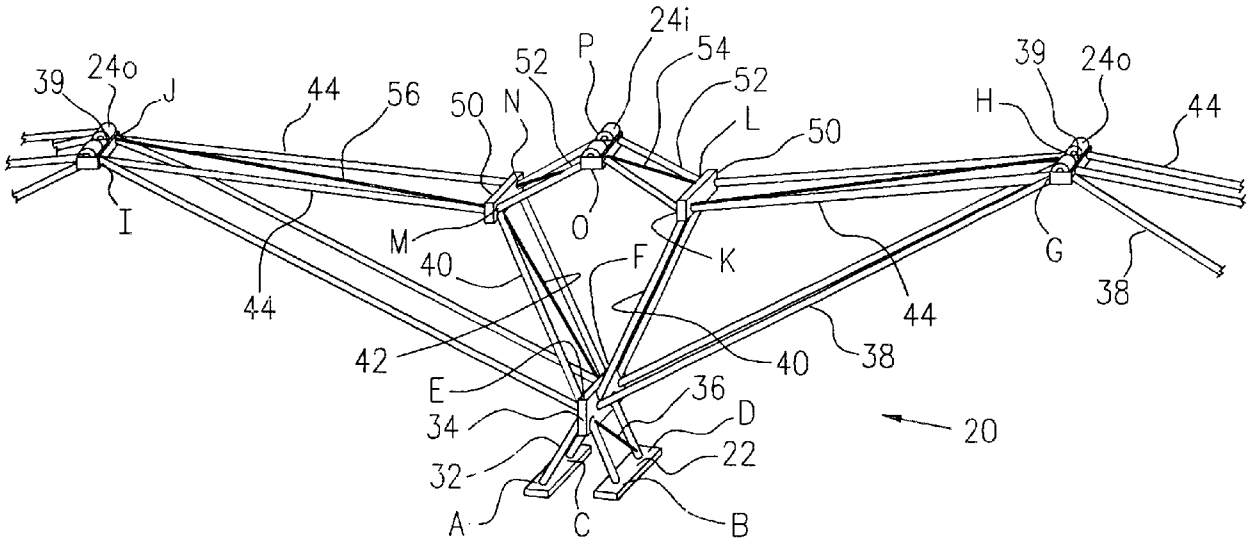
FIGS. 7 and 7A are illustrations of a medium span stanchion, FIG. 7 being a perspective view, and FIG. 7A showing how the medium span stanchion may accommodate temperature expansion.

There are therefore four types of stanchions which meet these criteria, the two differing short span stanchions, and long and medium span stanchions, shown in FIGS. 6 and 7, which are triangular in shape.

Figure 2:
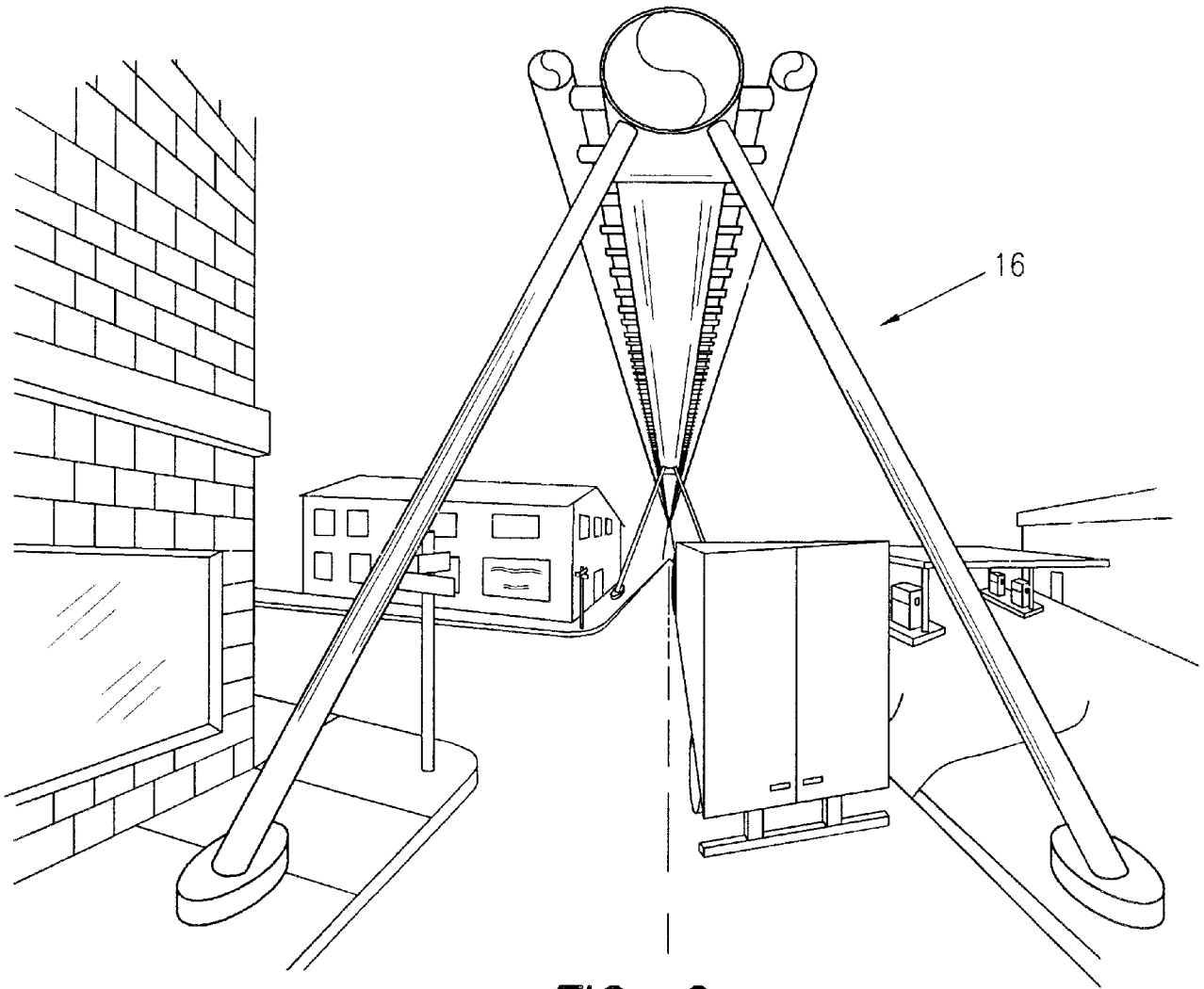
FIG. 2 is an illustration of one species of the support assemblies of this invention when used in an urban setting.

The guideway tube assembly 12 will pass over many different types of terrain as can be seen from FIG. 1. In many, relatively flat, rural areas, for example, it may be supported by a stanchion 14 in the form of a single, vertical column of moderate height, spaced only 125 feet apart. This minimal structure would be adequate for passing over undeveloped land, some secondary roads and for using or sharing already existing rights of way. A locally reinforced guideway can extend this span to at least 150 feet. A second design of stanchion 16 may be of an inverted V shape when it is necessary to extend above a road bed as shown in FIG. 2. The short span stanchions 14 and 16 support one tube span of 150 in length.

The long span stanchions and medium span stanchions, which are of novel design, will be referred to as triangular stanchions. The triangular stanchions are in the form of an inverted triangle with the apex resting on a foundation or ground footings 22, while the upper parts defined by the wheel sets 24 will lie in a horizontal plane so as to engage and support the guideway tubes. The triangular stanchions are constructed of slim tubular sections welded together. The triangular form of the stanchion permits the guideway tubes to be elevated to virtually unlimited heights and have very long spans between ground footings.

Another major purpose of all stanchions are to provide a horizontal, straight, platform on which to mount rollers on wheel sets 24, which support the parallel tubes 25, yet permit them to move axially, i.e., in the direction of the stanchions. The wheels 24*a* of the wheel sets 24 engage continuous tracks 28 attached to sides of the tubes as best shown in FIG. 10 and confine its movement so as to only allow axial motion.

Interconnected Stanchions

Figure 8:
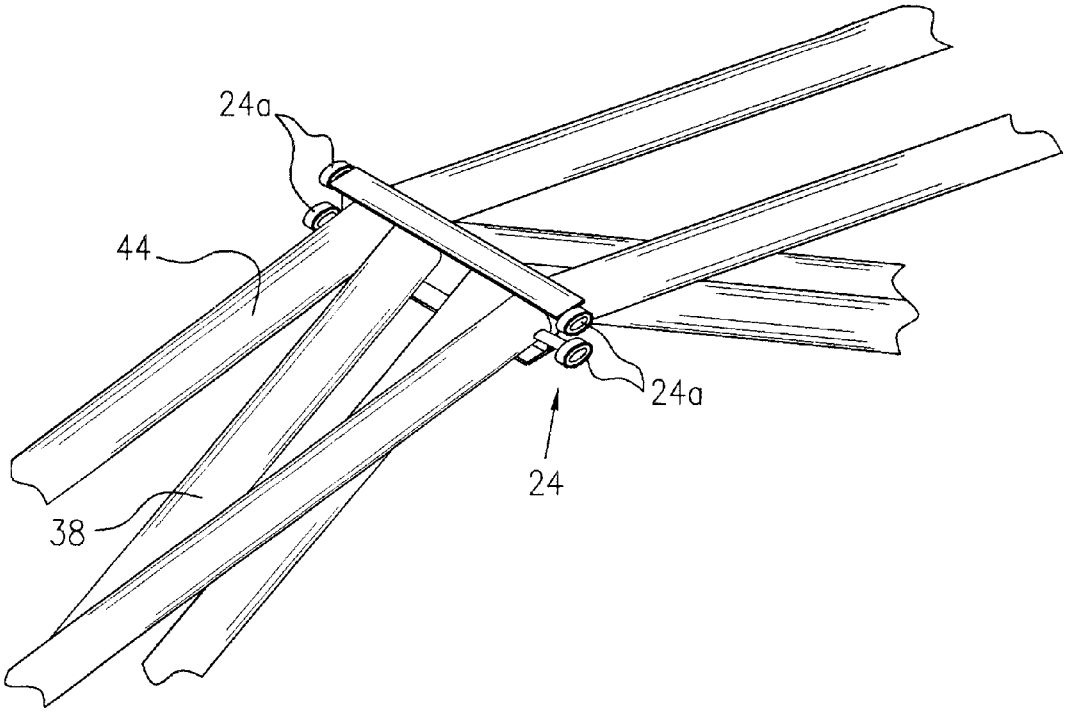
FIG. 8 is a view of the outer wheel sets of the medium span stanchion shown in FIG. 7.
Figure 9:
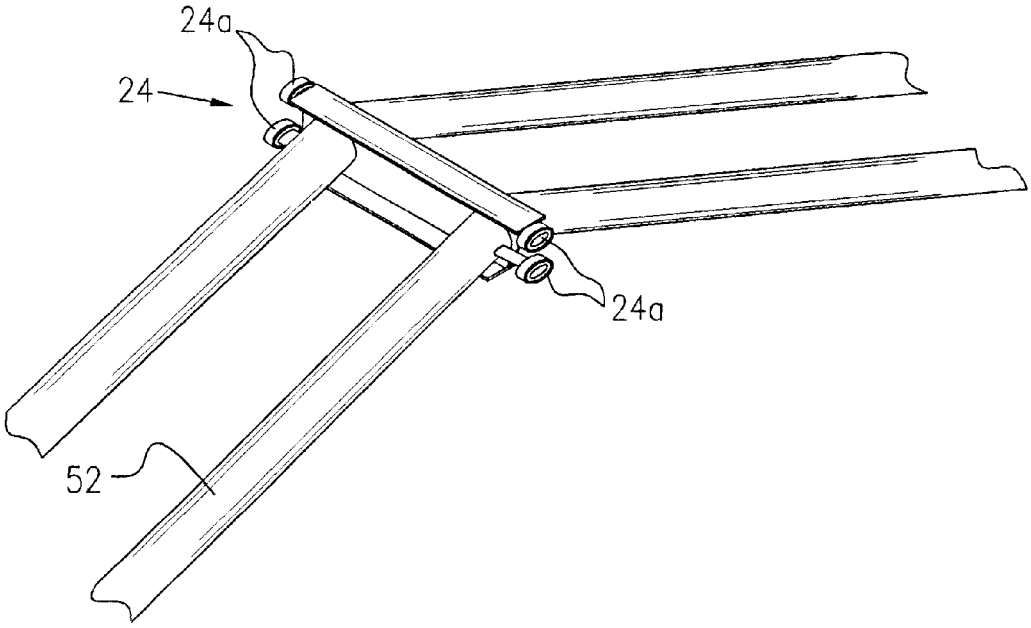
FIG. 9 is a view of the inner wheel sets of the medium span stanchion shown in FIG. 7.

The triangular stanchions are designed to be linked together horizontally as can best be seen in FIGS. 1 and 6–8, each triangular stanchion having three or four wheel sets equally spaced apart. As shown in FIGS. 7 and 8, adjacent stanchions share two wheel sets, thus providing a continuous series of uniform supports.

Both thermal expansion and the application of the weight of the train produce equal vertical deflections of each wheel set, therefore maintaining a continuous horizontal and straight guideway for the train.

The outer wheel sets of the triangular stanchions may only move vertically (due to thermal expansion or compression loading of the outer arms) because each is directly linked with that of the adjacent stanchion or is connected to them by a horizontal linking bar 29.

The length of this link is limited by the amount of acceptable deflection caused by the "rocking" motion of the stanchion about the ground footing as an approaching train applies weight to one side of the triangular stanchion, the amplitude of this deflection is controlled by the rigidity of the guideway tubes, which apply upward and downward forces to the adjoining stanchions through the tube rails and wheel sets.

The vertical deflections of all stanchion wheel sets, due to the differing deflections between the supporting tubes, and also the "rocking" of the stanchions with the passing of a train are thus virtually equalized. This is an important feature for maintaining a smooth ride for the passengers, otherwise, they would feel the vertical accelerations as the train passed over soft and rigid points in the guideway. These accelerations, occurring at frequencies of up to three cycles per second, would be quite disturbing to the passengers.

The Long Span Stanchion

With reference to FIG. 6, the long span stanchions 18 are all interconnected along the length of the guideway. The long span stanchion supports three maximum guideway tube spans, each of which is up to 150 feet in length between supporting wheel sets 24. There are two pairs of outer and two pairs of inner wheel sets, 24*o* and 24*i* respectively. The outer wheel sets may be a part of the interconnections between adjacent stanchions, as shown in FIG. 7. Alternatively, horizontal linking bars 29 may extend between adjacent long span stanchions 18.

The stanchion 18 is formed primarily of tubular columns and includes of a symmetrical A-frame base assembly 30 including a pair of transversely spaced apart inverted V-shaped frames 32, one on each side of the guideway path, resting upon ground footings 22, and extending upward to connect with a lateral cross-beam 34 located at approximately one half the height of the guideway tubes. Two pairs of lower outer arms 38 of the stanchion extend outward from the base of the "A" frames and connect to the outer wheel sets 24*o*. An upper horizontal crossbar 39 extends between the upper outer ends of each pair of arms 38, the associated outer wheel sets 24*o* being connected thereto.

Two pairs of relatively short inner arms 40 of the stanchion connect the top of the "A" frames to the inner wheel sets 24*i* and horizontal crossbars 41. Suitable braces 42 may be employed.

Two pair of upper horizontal outer arms 44 connect the inner with the outer wheel sets 24*o*.

Figure 6A:
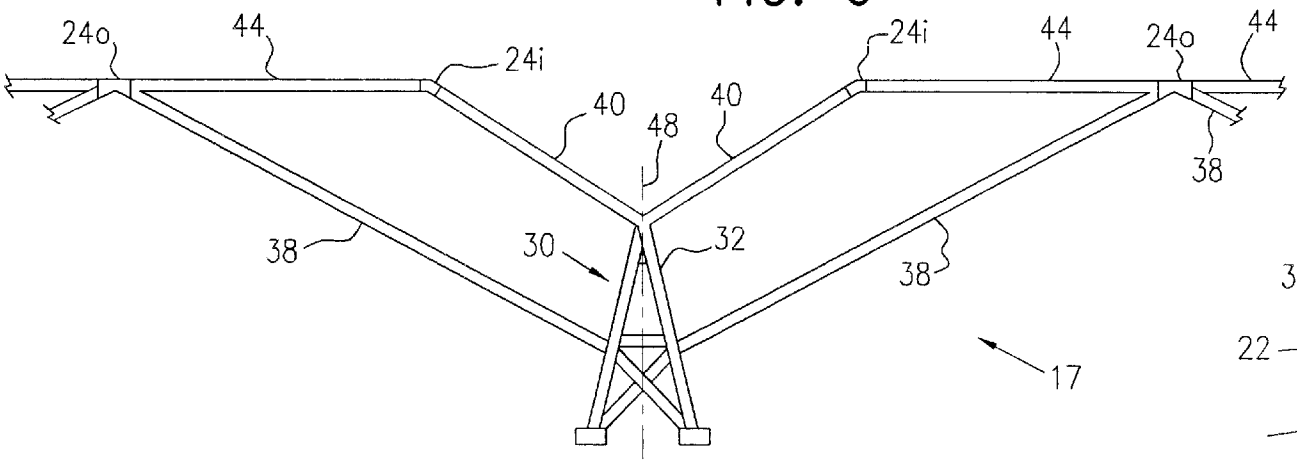

The lengths of all stanchion members are proportioned such that thermal expansion will cause equal vertical movement of all wheel sets. This concept is illustrated in FIG. 6A. Furthermore, the stanchion provides each wheel set with the same, but independent, "stiffness" to resist vertical loads, so that the passing train will not encounter repetitive "hard and soft spots" in the guideway This vertical stiffness effect parallels that of the equal vertical temperature, deflections when the stress in each stanchion member is also selected to be the same for the same wheel set loads. This is because each member expands proportionally to temperature changes and it's length, while each member also deflects from vertical loadings proportionally to its load and its length for the same stress. Since the geometry of the shape of the stanchion is such that temperature expansions cause the wheel sets to rise or fall the same vertically, they will also do so under the same loads.

As the train passes over a number of wheel sets, the mid-portion of the train will depress the wheel sets more than will the ends of the train. This portion of the train will therefore "sag" as it travels along successive stanchions in the guideway. This happens as the train passes over wheel sets of equal "softness", and is one of the purposes of the stanchion design. It is essential that the train does not experience repetitive "hard and soft spots", which would cause discomfort for the passengers or require increased capacity of train suspension system.

Stanchion deflections of the wheel sets are limited by design to be less than ¼ inch while the mid-span deflections of the guideway tubes (between wheel sets) are also so designed to be less than ¼ inch. A special suspension system has been designed for the train, which will accommodate these deflections.

A low ground clearance design of lower outer arms 38 are shown in FIG. 6. However, when greater ground clearance is required, the arms may be angled as shown in FIG. 6A. If this is the case, than a brace 37 may be employed.

Figure 6B:
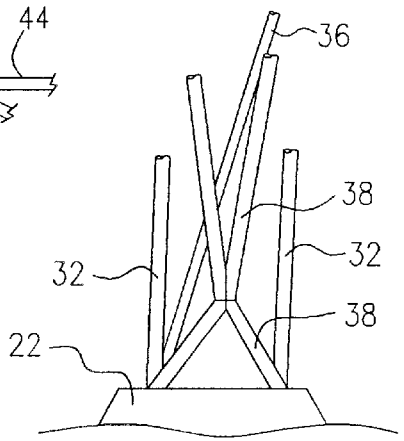
FIG. 6B is a end view of the high ground clearance stanchion shown in FIG. 6A.

As can be seen from FIG. 6B, the arms 38 intersect at the centerline of the 48.

The Medium Span Stanchion

Figure 7A:
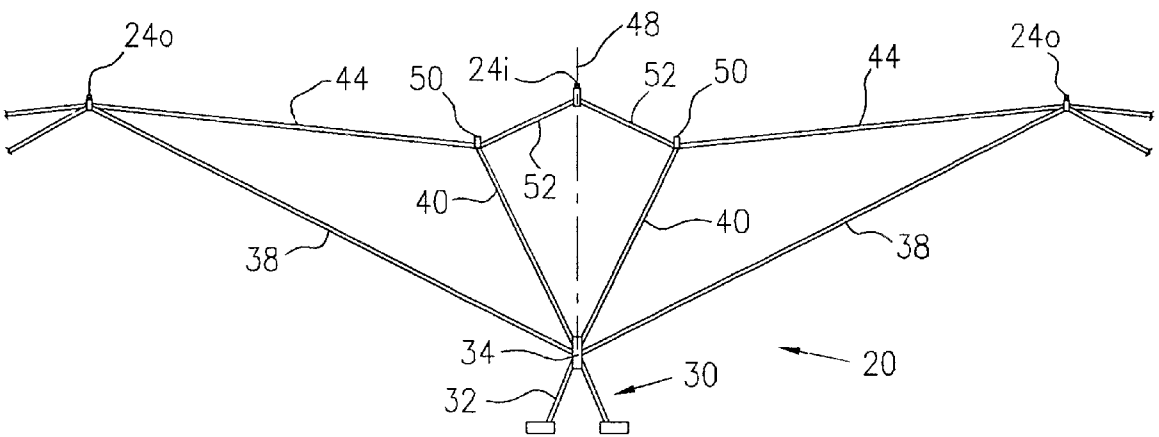

With reference to FIG. 7, the medium span stanchion performs all of the functions of the long span stanchion, but it is shorter and extends only over two guideway tube span lengths. Thus, the medium span stanchion supports two maximum guideway tube spans, each of which is up to 150 feet in length between supporting wheel sets 24. The combined thermal expansion rate (see FIG. 7A) and rigidity of each structural member also keeps the three wheel sets 24 at the same height with the same stiffness against vertical loads.

The layout of the medium span stanchion configuration differs from that of the long span stanchion. There are only three wheel sets per stanchion, two outer sets 24*o*, and a center set 24*i*, each of the outer sets being associated with a horizontal crossbar 39, and the inner set being associated with a horizontal cross bar 41. The symmetrical "A" frame base assembly 30 is shorter. The top formed by a lateral cross beam 34 (apex) of the "A" frames is at the junction of both the lower outer and inner arms 38, 40.

There are four sets of arms on each side of the stanchion centerline 48:

1. Lower outer arms 38 connect the top 34 of the "A" frame 30 with the outer wheel sets 24*o* and the arms 38, 44 of the adjoining stanchions.
2. Inner arms 40 connect the top 34 of the "A" frame to junctions 50 of both upper outer arms 44 and center arms 52.
3. The upper outer arms 44 connect the junctions 50 to the outer wheel sets 24*o*.
4. The center arms 52 connect the junctions 50 to the center wheel sets 24*i*.

The arm sets may be suitably braced by braces 36, 42, 54, and 56.

Medium span stanchions 20 are to be used wherever the long spans 18 are not necessary, and where the spacing of single span stanchions is too short. Long span stanchions are designed to maintain a uniform guideway height over long depressions, such as valleys, while medium span stanchions may best be used to span small streams or wide highways, while the short single span, single post stanchions are adequate for traversing farm land, undeveloped lands, forests, and most country roads. The short span stanchions are also ideal for sharing highway and railroad rights of way.

Short Span Stanchions

The short span stanchions are single vertical tubular posts, each supporting a single pair of wheel sets at the top. While the height of the short stanchion may vary widely, the nominal height is 100 feet, which allows a ground clearance-for the train of 80 feet.

The nominal distance between the short span stanchions and all wheel sets is 125 to 150 feet, depending upon the guideway tube wall thickness, and also whether local tube reinforcement is used.

Long Span Stanchion Variation

Figure 3A:
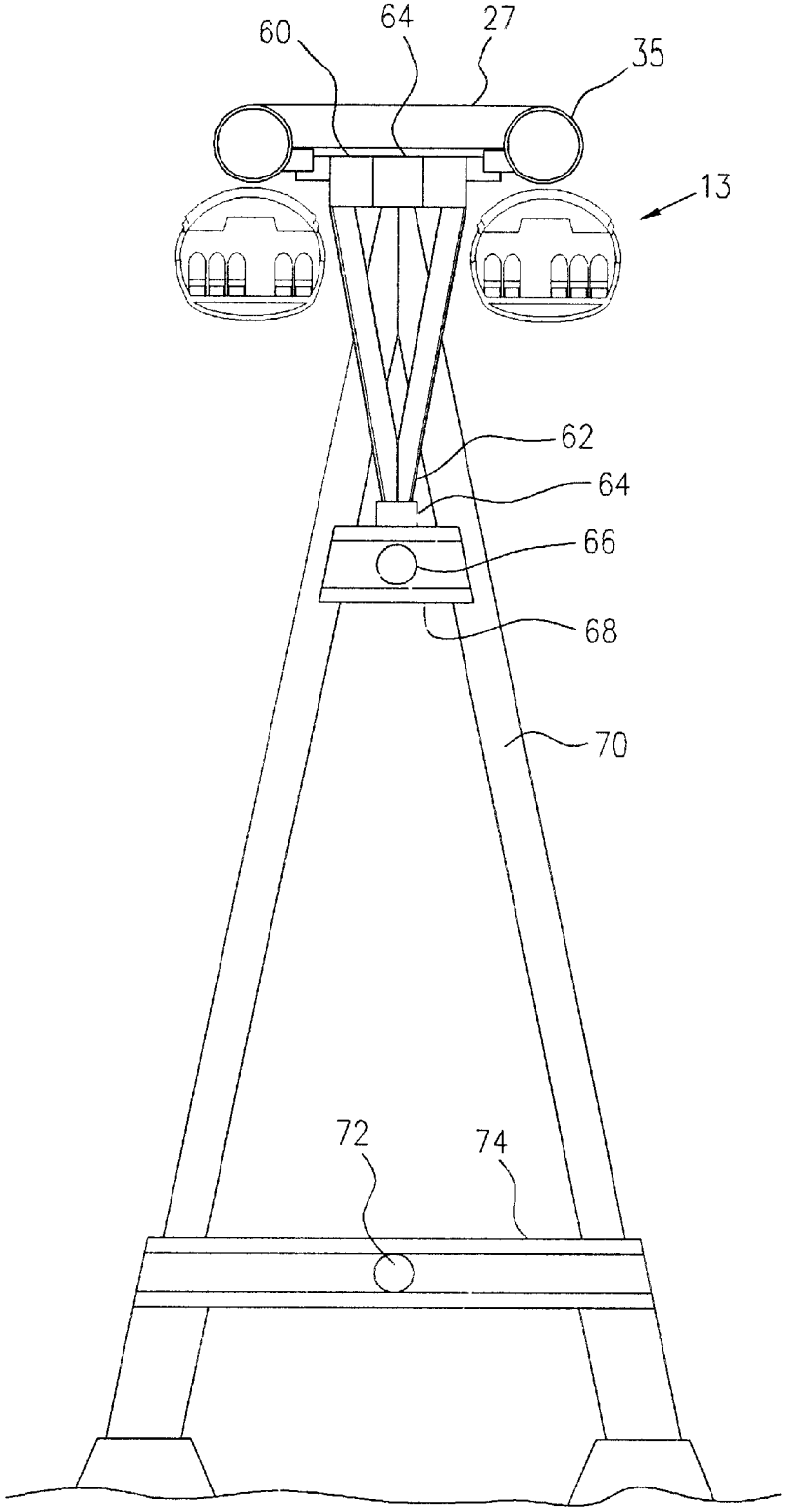
FIG. 3A is an enlarged view of the support stanchion shown in FIG. 3.
Figure 3B:
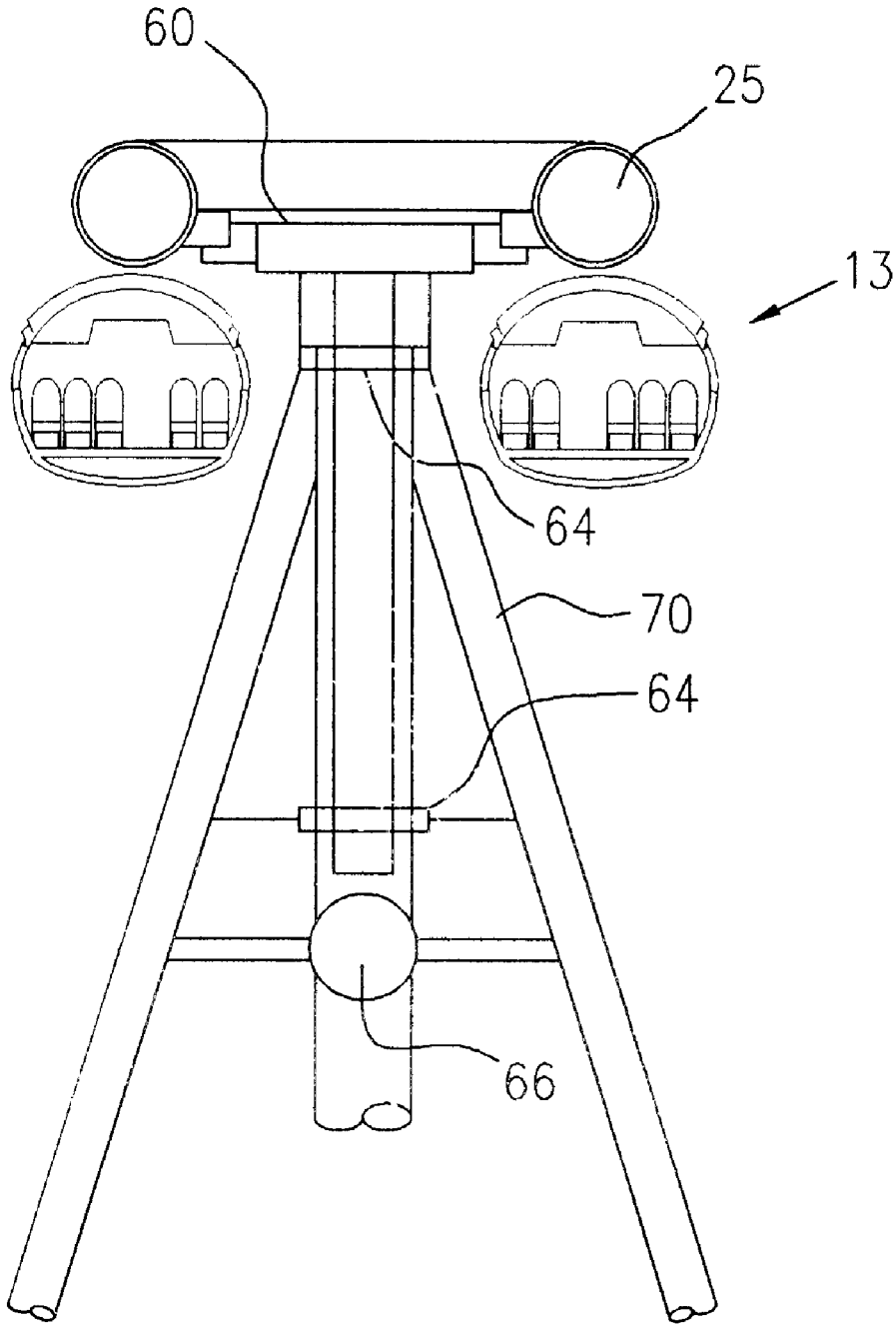
FIG. 3B shows a "T" bar beam, which is an alternative to the lateral cross bar construction shown in FIG. 3A.
Figure 4:
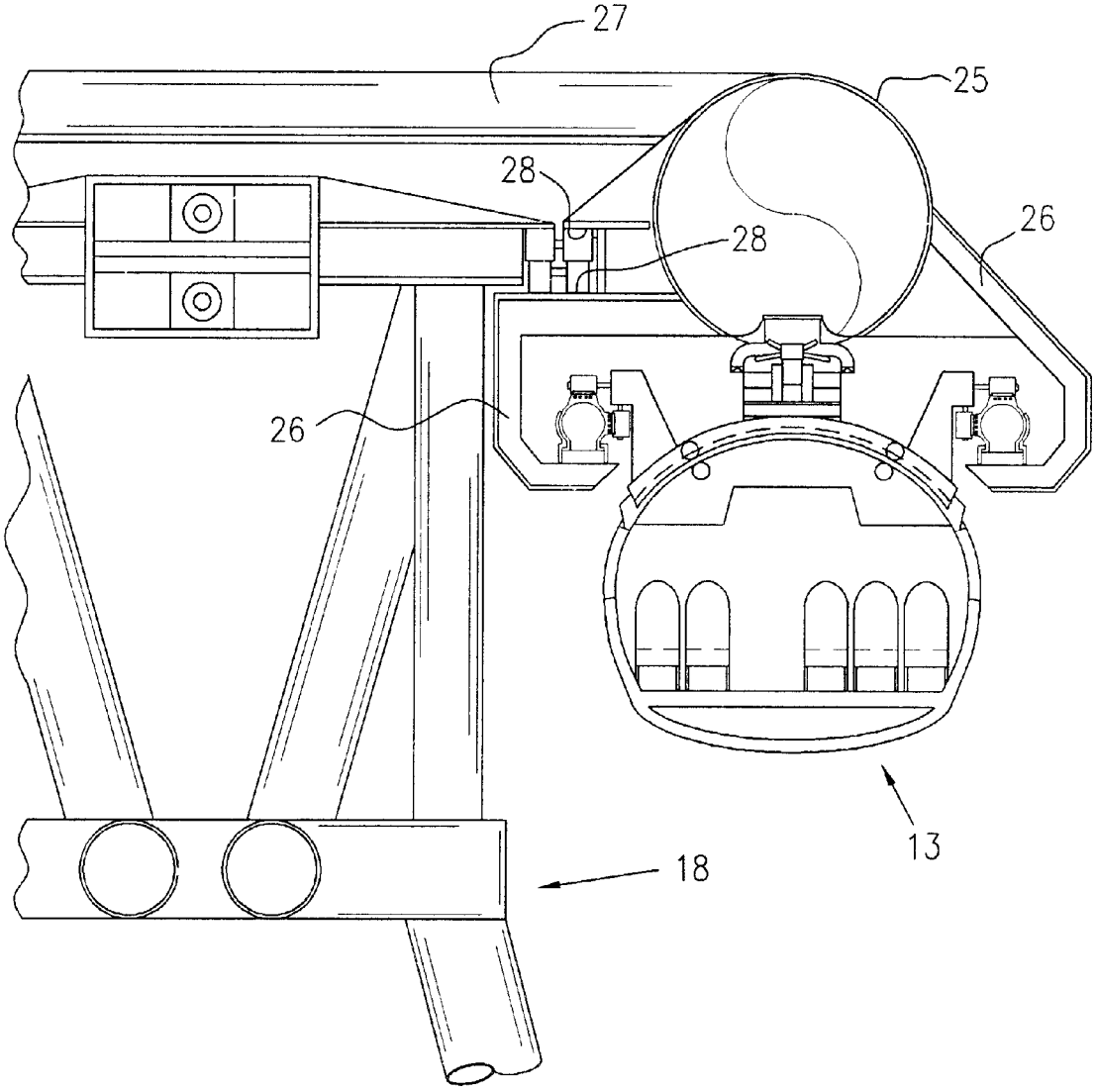
FIG. 4 is a partial sectional view of the design as shown in FIG. 3 illustrating how a railway train may be supported by the guideway tubes, the train being below the guideway tubes.

With further reference to FIGS. 3—3*b*, a variation of a long span stanchion is illustrated. With further reference to FIG. 3A, the following elements are shown: a "T" bar 60, cross flow tube 27, guideway tubes 25, vehicles 13, diagonal "T" bar rods 62, upper and lower slip rings 64, inner stanchion arms 66, upper "A" frame beam 68, "A" frame leg 70, outer stanchion arms 72, and lower "A" frame beam 74.

The purpose of the cross bar 60 is to provide a more uniform rotational deflection over the length of the twin guideway tubes 25 as a train 13 passes along beneath one of the tubes. This "Rotational Moment" is caused by the weight of the train and the cantilevered distance from the centerline of the train to the effective center of the supporting stanchion.

Since the purpose of the stanchions are to reach across a maximal span between ground supports, each stanchion employs long, branching arms 66, 72 which do not necessarily contribute much rotational stiffness to the guideway they are supporting.

Angular rotational loading of the twin tube guideway due to the weight of a train bearing down on only one tube, is supported only by the triangular configuration of all of the stanchion arm sets acting together. The compressive force of the train weight is transmitted by the diagonal arms on that side of the guideway, directly down to the center points of the horizontal "A" frame beams at the apex of the triangles.

Angular rotation (and all lateral motion) of the guideway tubes about the "A" frame beam centers due to both single side loading, and centrifugal force of the train (from a curve or cross wind) is restrained by a lateral horizontal cross bar at the top (apex) of the "A" frame, which extends between the roller tracks of each tube. Longitudinal, vertical and rotational motion of the tubes is not restrained, so it does not present a vertically rigid tube support which would be incompatible with the more flexible wheel supports of the stanchion arms.

The "T" bar beam, best shown in FIG. 3B, is an alternative to the lateral cross bar. It provides the rotational constraint of the guideway while permitting the use of single, rather than double, arm sets for the stanchions. It is located at the top (apex) of each "A" frame, and has a horizontal "T" bar with wheel sets at its extremities which engage the guideway tracks. It transmits the guideway torque from the "T" beam to the vertical "T" column, which in turn distributes the torque to the upper "A" frame configuration of the stanchion legs, thereby relieving the legs from most of the bending moment and the arms from all of this bending moment. The twin tube guideway assembly has enough rigidity to transfer its torque to adjacent stanchions.

The "T" column moves vertically through slip rings (at the upper apex and lower cross arm of the "A" frame), so as to accommodate the unequal vertical thermal expansion and load deflections of the stanchion legs and the stanchion load supporting wheel sets.

Alternatively, the ends of the "T" beam may be connected to the lower slip ring by diagonal rods rather than by a center column, resulting in a lighter weight assembly.

In the design shown in FIGS. 3–3B, the outer stanchion arms need not be forked like arms 38, but may be a singular tubular construction.

Column Design

The stanchions employ a number of slender, compression members, generally referred to as "columns". Some of these columns approach the "Critical Slenderness Ratio" of 60 to one (L/D), wherein the bending stiffness becomes the limiting factor determining the loading capacity. Further more, hollow tubes may fail prematurely by buckling inward, which may be initiated by a minor indentation in the outer surface, and it has not been generally considered good practice to employ "long" columns in bridge construction. Long tubular structural members have been used extensively in aircraft construction however, since they offer the ultimate in load carrying capacity for their weight.

Figure 12:
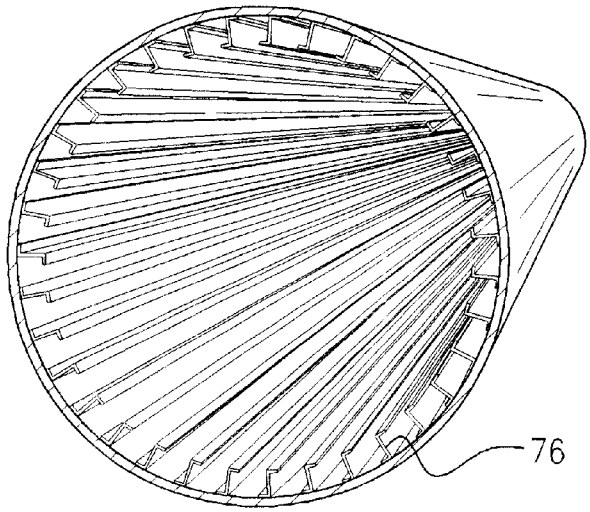
FIG. 12 shows a column provided with "Z" stringers.
Figure 12A:
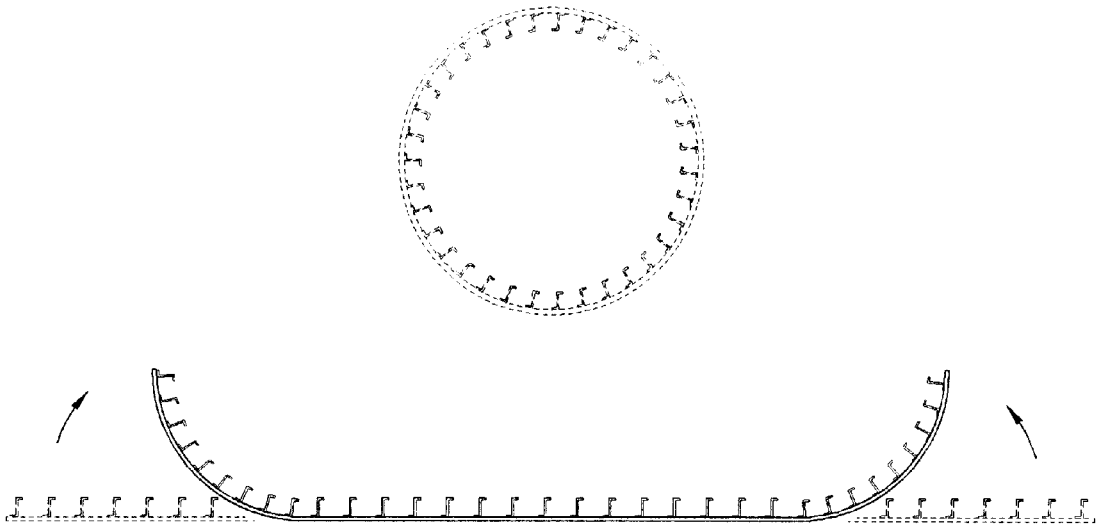
FIG. 12A shows how the column of FIG. 12 may be constructed.

This invention applies to all compression columns, and consists of a design and fabrications wherein the inward collapse of the tube wall is precluded as a premature cause of column failure. The invention also describes a structural configuration which may be easily fabricated by commonly used bending and welding methods. Furthermore, this column does not use any more material than would the same bare hollow tube column, based upon compression stress only, because tube wall stiffening ribs 76 (FIG. 12) share the column load. These longitudinal ribs, attached to the inner tube wall are most effective in preventing tube buckling, since they run in the direction perpendicular to the axes of any buckling indentation as the indentation would tend to progress. The mounting of the ribs (in the form of stringers) to the tube surface in parallel, permits the stringers to be attached to a flat sheet of metal which may then be easily formed (rolled up) into a tubular shape and then continuously seam welded where the sides meet. This may be accomplished without needing bend the stringers. Furthermore, the stringers may easily be continuously seam or spot welded to the flat sheet before bending thereby eliminating the need for special tooling to attach or weld the stringers to the inside wall of the tube.

Figure 13:
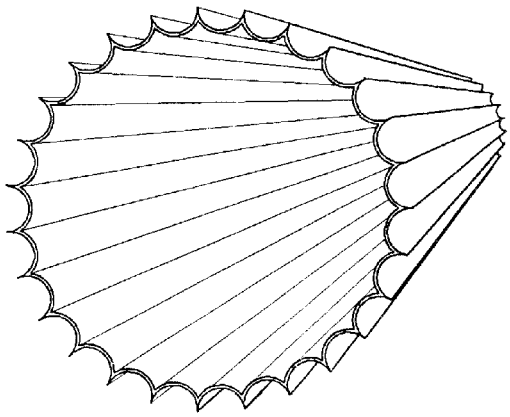
FIGS. 13–15 show alternative column designs.
Figure 14:
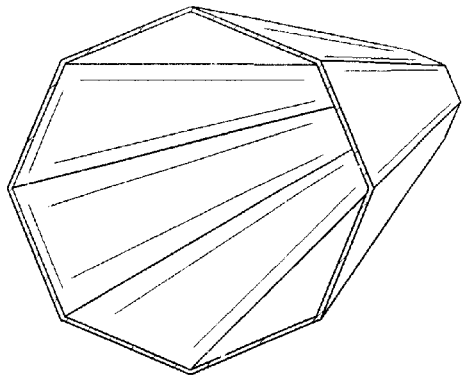
Figure 15:
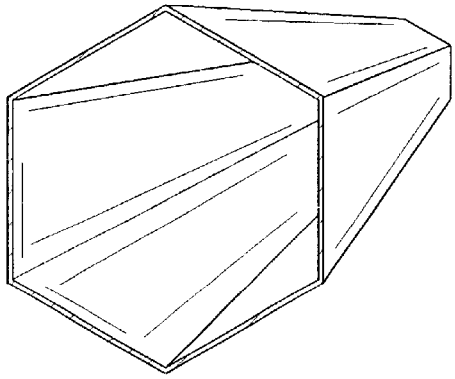

Three alternative designs of columns are shown in FIGS. 13–15.

First Alternative Train Support Design

Figure 16:
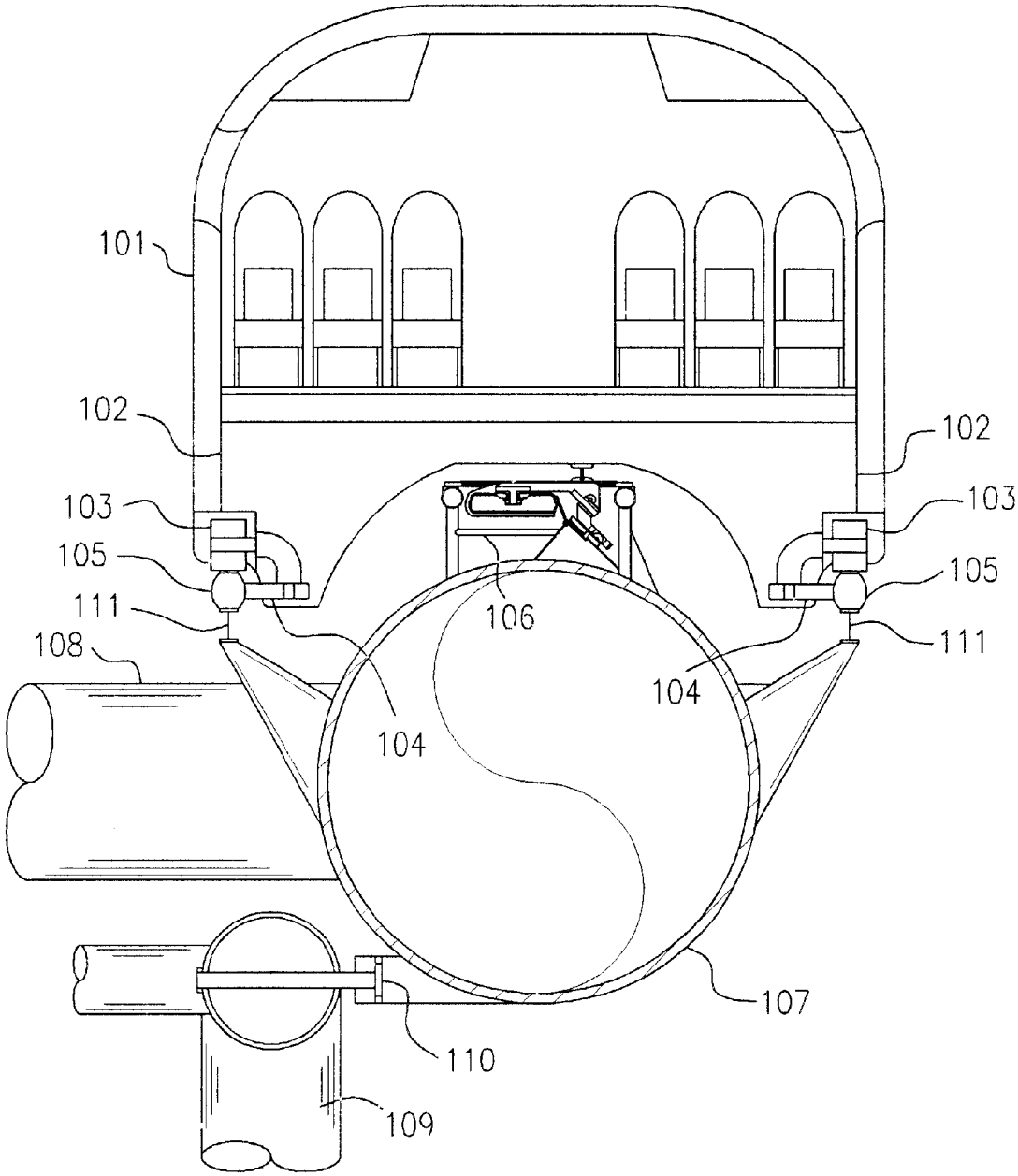
FIG. 16 is a view similar to FIG. 4, but showing how a railway train may be supported above a guideway tube.

FIG. 16 shows a railway train 101 supported upon a pressurized guideway tube 107. The train includes a carriage 102 including carriage main wheels 103 and carriage guide wheels 104. These wheels engage a soft or "tire" track 105 which is carried by "I" beams 111 on the guideway tube 107. A propulsion assembly 106 extends between the carriage 102 and the guideway tube 107. The propulsion assembly includes a saddle, strip valve, nozzles, and thrust vanes for forward and reverse. Also shown in this view are cross flow tubes 108, stanchion tubes 109 and stanchion wheel guideway supports 110.

Second Alternative Train Support Design

Figure 17:
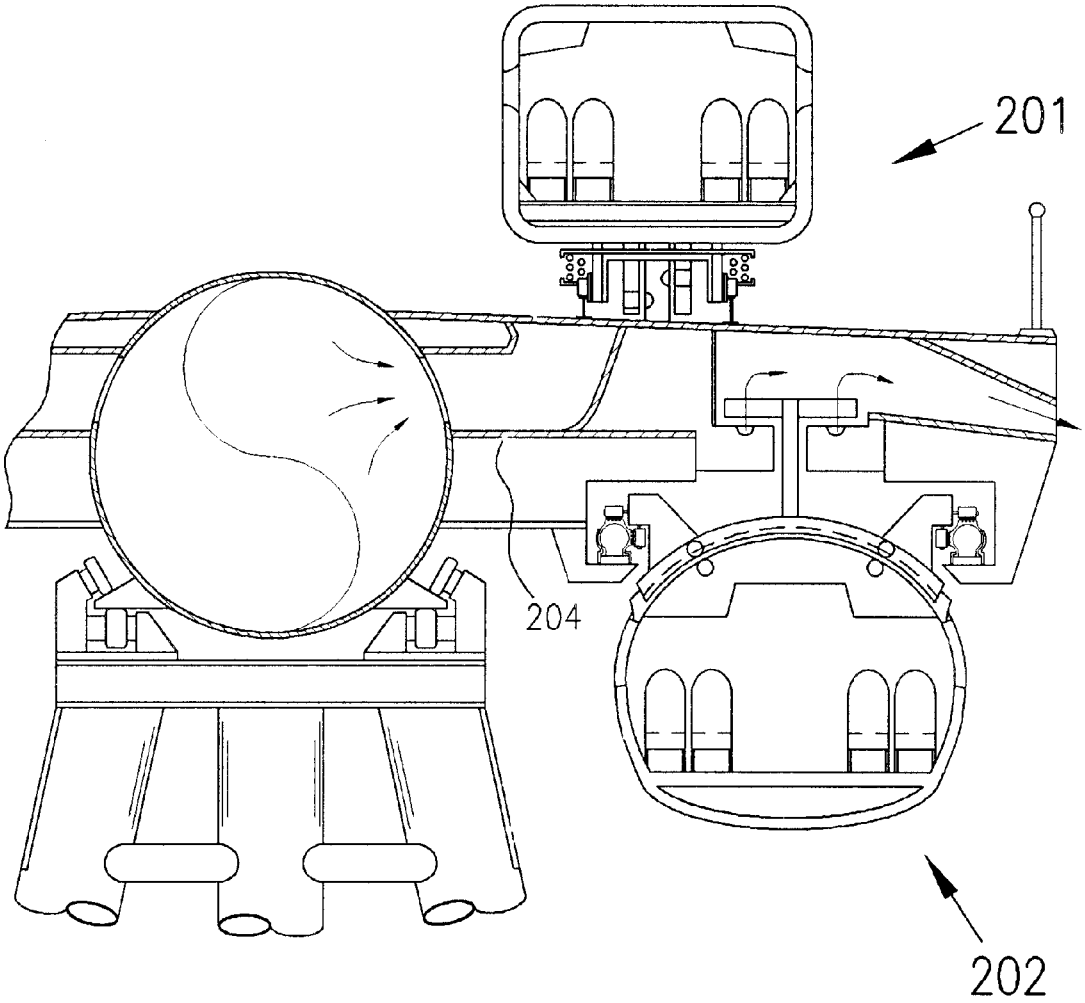
FIG. 17 is a partial sectional view showing a guideway tube assembly employing a single tube.

FIG. 17 shows railway train 201 and 202 supported upon a cantilevered structure 204 which is in turn carried by a pressurized guideway tube 206. As this design is more fully discussed in copending application Ser. No. 10/013,037 it will not be described further. The only purpose of this illustration is to show that the guideway tube assembly may incorporate a single tube, rather than the parallel tubes best shown in FIG. 3.

While the best modes of this invention known to applicant at this time have been shown in the accompanying drawings and described in the accompanying text, it should be understood that applicant does not intend to be limited to the particular details illustrated in the accompanying drawings and described above. Thus, it is the desire of the inventor of the present invention that it be clearly understood that the embodiments of the invention, while preferred, can be readily changed and altered by one skilled in the art and that these embodiments are not to be limiting or constraining on the form or benefits of the invention.

What is claimed is:

1. A support structure for supporting a railway, roadway, or pipeline; the support structure comprising:

a ladder shaped guideway tube assembly including a pair of longitudinally extending interconnected relatively rigid guideway tubes, which tubes form a continuous structure for supporting the roadway, railway or pipeline, roller supports for supporting the roadbed, railway or pipeline, and transversely extending cross flow tubes for rigidly connecting the pair of guideway tubes to each other;

a plurality of stanchion assemblies; and wheel sets carried by the stanchion assemblies for supporting the guideway tube assembly.

2. Support structures for supporting a railway, roadway, or pipeline, which support structures may be linked to each other in a continuous series without the use of expansion joints; the support structures comprising:

a plurality of stanchion assemblies, each stanchion assembly including a symmetrical A-frame base assembly including a pair of transversely spaced apart inverted V-shaped frames extending upwardly to an apex on a centerline of the A-frame base assembly, two pair of spaced apart relatively short inner arms having lower and upper ends, the inner arms extending upwardly and outwardly from the apex of the inverted V-shaped frames to which the lower ends are secured, one pair of the inner arms being on one side of the centerline of the A-frame base assembly and the other pair being on the other side of the centerline, two pair of upper outer arms having inner and outer ends, the inner ends being secured to the upper end of the inner arms, one pair of the upper outer arms being on one side of the centerline of the A-frame base assembly and the other pair being on the other side of the centerline, and two pair of lower outer arms having inner and outer ends, the outer ends being secured to the outer ends of the upper outer arms, and the inner ends being connected to the A-frame base assembly, one pair of the lower outer arms being on one side of the centerline of the A-frame base assembly and the other pair being on the other side of the centerline;

three or more pairs of wheel sets for each stanchion assembly, an outer pair of wheel sets being carried by the upper outer arms and the lower outer arms where the arms are secured to each other, and at least one additional pair of wheel sets being carried between the outer pairs of wheel sets; and a guideway tube assembly carried by the wheel sets, which guideway tube assembly forms a continuous structure for supporting the roadway, railway or pipeline.

3. The support structures as set forth in claim 2 wherein each of the stanchion assemblies further includes footers, the pair of transversely spaced apart inverted V-shaped frames being supported on the footers, and wherein the inner ends of the lower outer arms are secured to the footers.

4. The support structures as set forth in claim 3 wherein the lower outer arms cross each other within the A-frame.

5. The support structures as set forth in claim 2 wherein four pair of wheel sets are provided, there being inner pairs of wheel sets carried by the upper end of the spaced apart relatively short inner arms and the upper outer arms where they are secured to each other.

6. The support structures as set forth in claim 2 further characterized by the provision of two pair of center arms, one pair being disposed to either side of the centerline of the A-frame base assembly, the center arms having upper and lower ends, the upper ends being joined together on the centerline of the A-frame base assembly, and the lower ends being secured to the upper ends of the inner arms.

7. The support structures as set forth in claim 6 wherein a pair of wheel sets is carried by the upper end of the center arms.

8. The support structures as set forth in claim 7 wherein a horizontal crossbar is carried by the upper end of the center arms between the wheel sets.

9. A support structure for supporting a longitudinally extending railway, roadway, or pipeline; the support structure comprising:

a footing assembly including a pair of parallel, horizontal, rectangular base footings, one footing having end points designated as points A and C, and the other footing having end points designated as points B and D, the points ABCD forming a horizontal rectangle, two vertical or slanted "A" frames having top; points E and F, one with arms linking top point E to A and B, and the other "A" frame with arms linking top point F to C and D, and a horizontal crossbar linking E to F;

a first pair of upwardly extending arms having their lower ends connected to the footing assembly and having upper points G and I, located upward and outward in opposite directions from point E, each equally distant from point E, and at equal elevations;

a second pair of upwardly extending arms having their lower ends connected to the footing assembly and having upper points H and J, lying in a line parallel to line GI, and being congruent with points G and I, respectively;

a pair of horizontal crossbars, linking G to H, and I to J;

arms extending upwardly from point E of the footing assembly and having upper points K and M, located upward and outward in opposite directions from point E, equally distant from point E, in the line GI, and each at the same elevation as points I and G;

arms extending upwardly from point F of the footing assembly and having upper points L and N, located upward and outward in opposite directions from point F, equally distant from point F, in the line HJ, and each at the same elevation as points H and J;

a pair of horizontal crossbars, linking K to L, and M to N;

a plurality of individual arms linking points G to K, M to I, H to L, and N to J; and links extending away from points G, H, I and J to adjacent support structures.

10. A supporting structure as described in claim 9 wherein the first and second pair of arms link points G, H, I, and J to the "A" frames.

11. A supporting structure as described in claim 9 wherein the first and second pair of arms link points G, H, I, and J to the footings.

* * * * *